US005222280A

United States Patent [19]

Dünnebier et al.

[11] Patent Number: 5,222,280

[45] Date of Patent: Jun. 29, 1993

[54] METAL CLIP FOR CLOSING MAILING ENVELOPES AND THE LIKE

[75] Inventors: Kurt Dünnebier, Neuwied; Alfred W. Doderer-Winkler, Melsbach, both of Fed. Rep. of Germany

[73] Assignee: Winkler & Dunnebier Maschinenfabrik und Eisengiesserei KG, Neuwied, Fed. Rep. of Germany

[21] Appl. No.: 771,790

[22] Filed: Oct. 4, 1991

Related U.S. Application Data

[63] Continuation of Ser. No. 569,728, Aug. 21, 1990, abandoned, which is a continuation of Ser. No. 305,370, Feb. 1, 1989, abandoned.

[30] Foreign Application Priority Data

Feb. 20, 1988 [DE] Fed. Rep. of Germany ..... 3805388

[51] Int. Cl.[5] ..... B65D 27/26

[52] U.S. Cl. ..... 24/703.5; 229/78 A

[58] Field of Search ..... 402/14, 18; 229/78 A, 229/78 B; 493/215; 24/703.1, 703.2, 703.5, 703.6

[56] References Cited

U.S. PATENT DOCUMENTS

| | | | |
|---|---|---|---|
| 94,088 | 8/1869 | Doane | 24/703.5 |
| 1,055,280 | 3/1913 | Klauu | 24/703.5 |
| 1,566,955 | 12/1925 | Curnau | 229/78 A |
| 2,325,702 | 8/1943 | Novick | 229/78 A X |
| 2,770,023 | 11/1956 | Michalsky | 24/703.5 |

*Primary Examiner*—James R. Brittain
*Attorney, Agent, or Firm*—Collard & Roe

[57] ABSTRACT

A metal clip is provided for closing mailing envelopes. The clip consists of three functional groups: a central body, two lateral closing flaps, and an anchoring device. The anchoring device has at least two triangularly shaped prongs bent out from a predetermined zone of the central body so that an opening is created therein. The prongs are arranged parallel with each other but opposite one another on opposing edges of the opening, so that bending edges of the prongs extend parallel with the longitudinal extension of the central body.

9 Claims, 4 Drawing Sheets

METAL CLIP FOR CLOSING MAILING ENVELOPES AND THE LIKE

This is a continuation of copending application Ser. No. 07/569,728 filed on Aug. 21, 1990, abandoned, which, in turn, is a continuation of Ser. No. 07/305,370, filed Feb. 1, 1989, abandoned.

The present invention relates to a metal clip for closing mailing envelopes and the like and which consists of a central body, lateral closing flaps and at least one anchoring device having prongs bent out from a predetermined zone of the central body, so that an opening is created whose edge contains the bending edges of the prongs.

Metal clips of the above type are used for fixing and maintaining the closing flaps of mailing envelopes and the like in a closed position on the back wall of the mailing envelope. For this purpose, such clips are anchored during manufacture of the mailing envelopes near the closing flap folding edge in the back wall of the envelope, with a spatial relationship to a fastening aperture arranged in the closing flap. For sealing the mailing envelope, the lateral flaps of the metal clip are bent up, inserted through the fastening aperture of the sealing flap when the letter is folded over, and then bent back again thereby securing the sealing flap.

It is well known and customary to manufacture such metal clips as punched parts. In their manufacture, the clips are fitted with anchoring devices having claws or prongs formed from material segments which are bent out from circular zones of the central body of the clip. The anchoring devices so formed have, in most cases, four prongs in the form of a bent circular cutout. The length of the prongs corresponds with half the diameter of the circular zone and is, therefore, relatively short. For this reason, such metal clips are inadequate for use with mailing envelopes having a center gluing.

With mailing envelopes having a center gluing, it is necessary for aesthetic and also for stability reasons to anchor the metal clip within the zone in which the two lateral flaps overlap. However, the free length of the prongs is insufficient to properly bend the prongs over, which, on the one hand, leads to problems with the securement operation and, on the other hand, often results in inadequate securement.

Furthermore, another serious drawback is that the conventional metal clips have in each case prongs which are difficult to fold over when the clips are attached, because their bending edges extend crosswise relative to the clip feeding direction. This requires, in the fixation of the clip, either a standstill phase during the flanging operation or cycled tools for the flanging step, which tools are expensive with respect to the controls therefor. Both solutions permit relatively low processing rates, so that it has not been possible until now to soundly mount the clips in an in-line production process on a high speed mailing envelope production machine. Another drawback is that the prongs, which are bent within themselves and which have a curved bending edge, require for their flanging or bending the application of a high force.

It is, therefore, a primary object of the present invention to provide a metal clip for the sealing of mailing envelopes and the like which can be safely and soundly fastened even on thick and multi-layer paper stock, requiring for the anchoring of such clip a relative low application of force. It is another object of the present invention that the metal clip is to be embodied in a way such that it can be processed in an in-line manufacturing process on a high-speed mailing envelope production machine without reducing the production rate.

The above objects are accomplished in accordance with the present invention by providing an anchoring device for the metal clip consisting of at least two triangularly shaped prongs arranged parallel but opposite to each other on the parallel edges of an opening, whereby the bending edges of the prongs extend parallel with the lengthwise extension of the central body.

The advantage obtained with the present invention particularly lies in the fact that due to the special design and arrangement of the prongs of the metal clip, both a greater length of the prongs and an easier bending thereof is achieved. This permits a secure attachment and anchoring of the clip even in multi-layered paper stock with application of a relatively low force. It is, furthermore, beneficial that by aligning the bending edges of the claws parallel with the longitudinal extension of the central body and with the direction in which the clips are transported, the metal clip can be processed in an in-line manufacturing process on a high-speed mailing envelope production machine.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
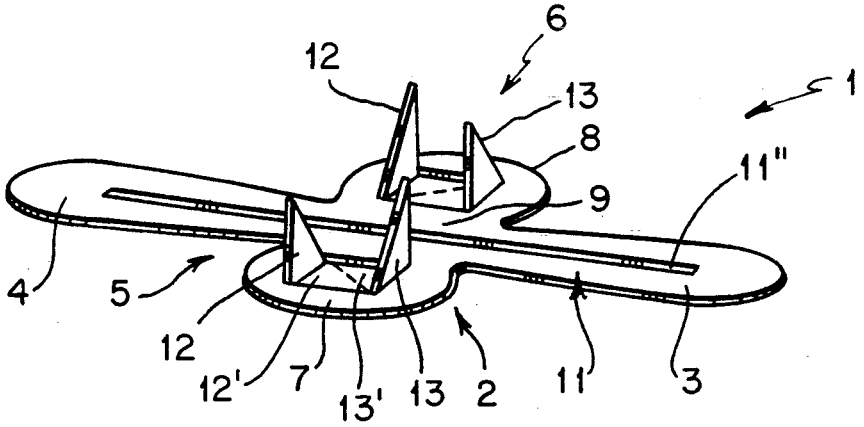
FIG. 1 is a perspective view of the metal clip according to the present invention.
Figure 2:
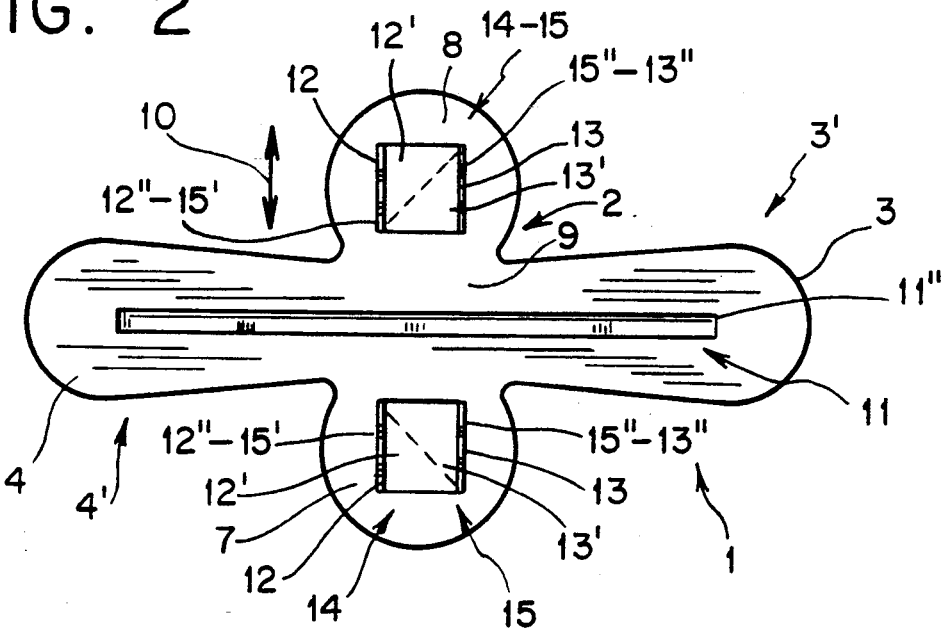
FIG. 2 is a top plan view of the metal clip from the side of the prongs.
Figure 3:
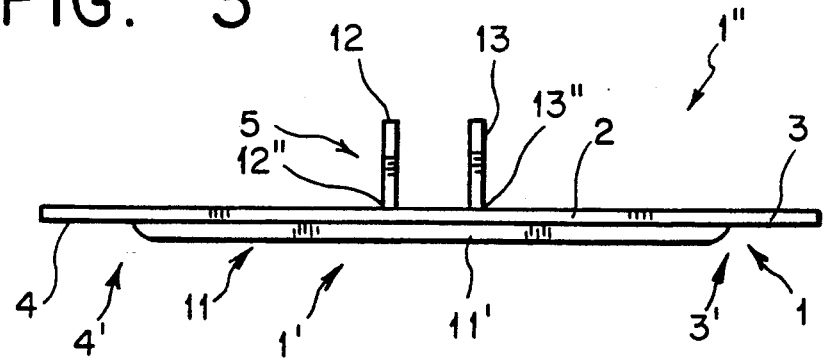
FIG. 3 is a side elevational view of the metal clip.
Figure 4:
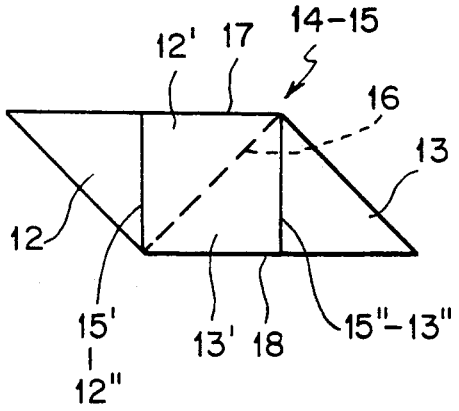
FIGS. 4 to 9 are views showing variations of the shape of the prongs.
Figure 5:
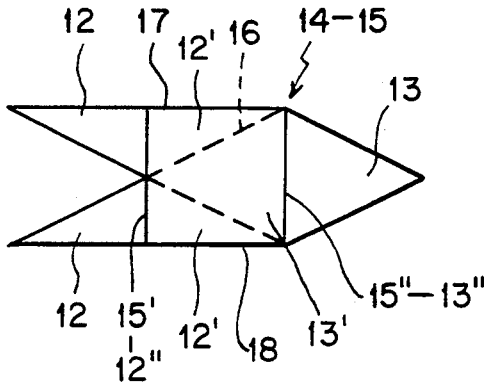
Figure 6:
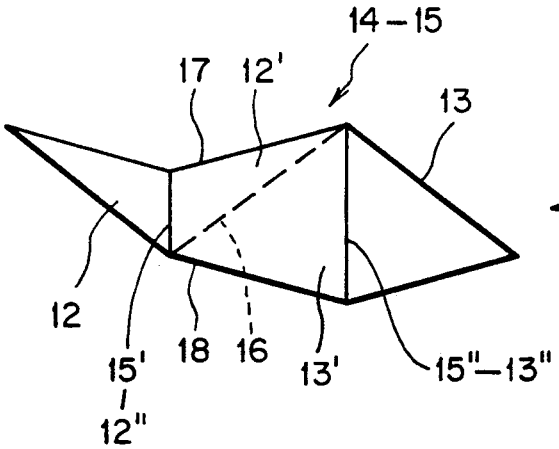
Figure 7:
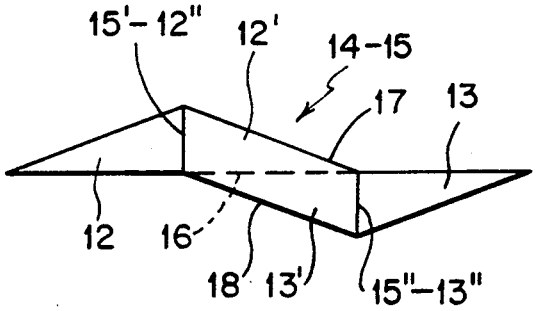
Figure 8:
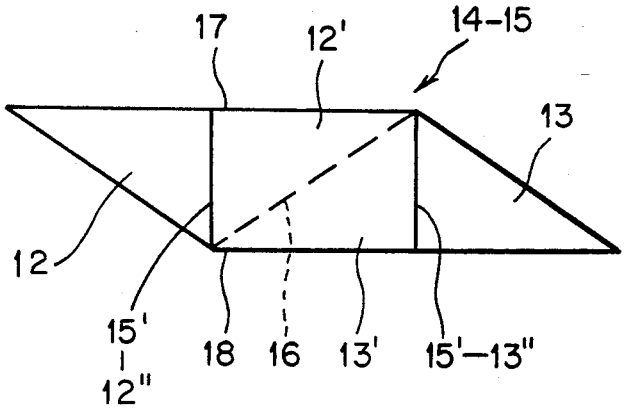
Figure 9:
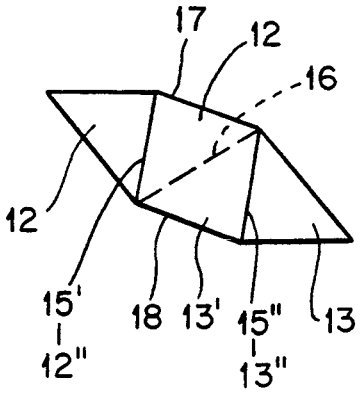

Now turning to the drawings, there is shown in FIGS. 1 to 3 a metal clip, designated 1, manufactured predominantly as a part punched from sheet metal. As an integral element clip 1 is divided into three functional groups: A central body 2, two lateral flaps 3 and 4, and two anchoring devices 5 and 6. The central body 2 is produced in the "form of a bone", forming a circular front part 7 and a circular back part 8, which are joined by a bridge 9. Transverse to longitudinal extension 10 of central body 2, bridge 9 extends to the left and right into the tongue-shaped, equally long closing flaps 3 and 4. Provision is made for a crimp or dimple 11 for stiffening closing flaps 3 and 4. On the top side 1' (see FIG. 3) of metal clip 1, crimp 11 appears in the form of a raised rib 11', and on the underside 1'' of the clip in the form of a groove-like deepening or trough 11''. Crimp 11 is arranged in the center relative to closing flaps 3 and 4 and extends from an end zone 3' of closing flap 3 and crosswise across bridge 9 and into the end zone 4' of the other closing flap 4. On the underside 1'' of metal clip 1, provision is made for anchoring devices 5 and 6 on front and back parts 7 and 8 respectively, of central body 2. Anchoring devices 5 and 6 are disposed in the center relative to front and back parts 7 and 8 and each consists of two prongs 12 and 13. Prongs 12 and 13 are formed by the material segments 12' and 13', which are bent out from predetermined square zones 14 of central body 2 at an angle of 90 degrees, so that square openings 15 are created in front and back parts 7 and 8 of central body 2. Prongs 12 and 13 are mirror-inversed, but arranged parallel with each other on opposed parallel edges 15' and 15'' of square opening 15. Each prong has the shape of a right-angled triangle with equal legs, of which one leg coincides with edge 15' or 15'' of opening 15, forming with such edge a folding edge 12'' or 13'' extending parallel with longitudinal extension 10 of central body 2.

FIGS. 4 to 9 schematically show a selection of possible prong shapes as well as associated zones 14, or openings 15 from which prongs 12 and 13 originate. Their common feature is that all zones 14 or openings 15 are quadrangles having at least two parallel side edges 15' and 15'', which at the same time represent bending edges 12'' and 13'' of prongs 12 and 13. In the production of the clip, prongs 12 and 13 are formed from material segments 12' and 13', which are bent out of zones 14. In this step, material segments 12' and 13' are separated from each other and from central body 2 along separation lines 16, 17 and 18, so that they remain connected with central body 2 along only one side, which represents bending edges 12'' and 13''.

Figure 10:
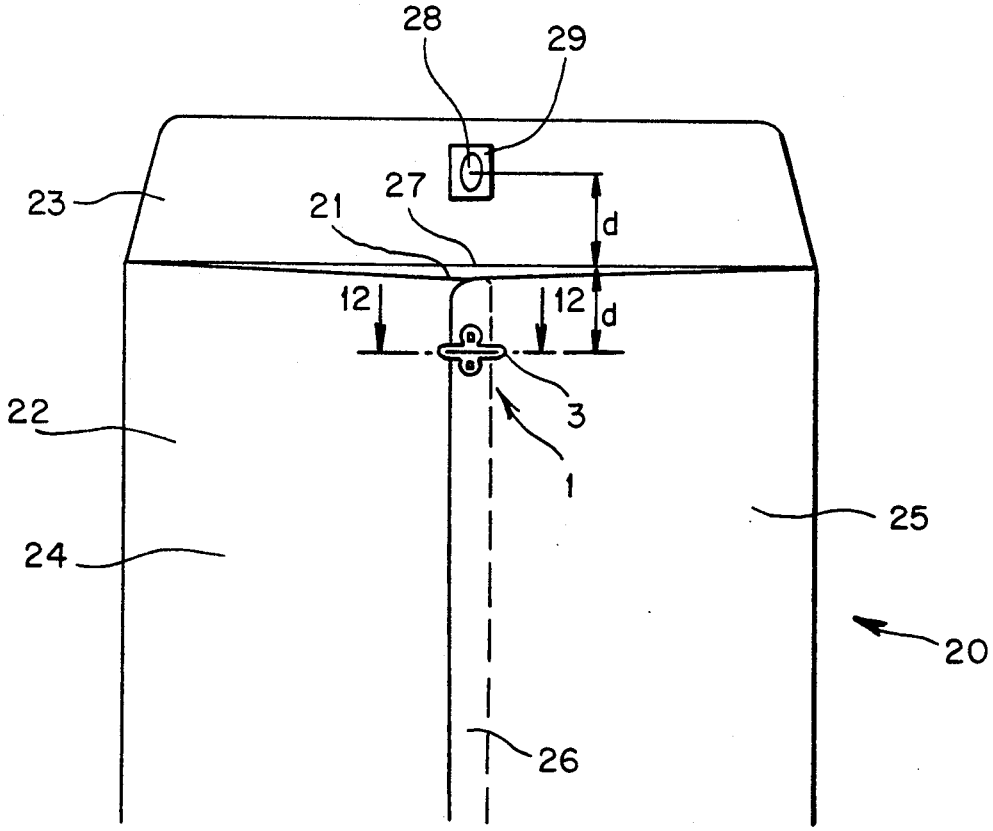
FIG. 10 is a plan view of an open mailing envelope with the metal clip attached thereto.
Figure 11:
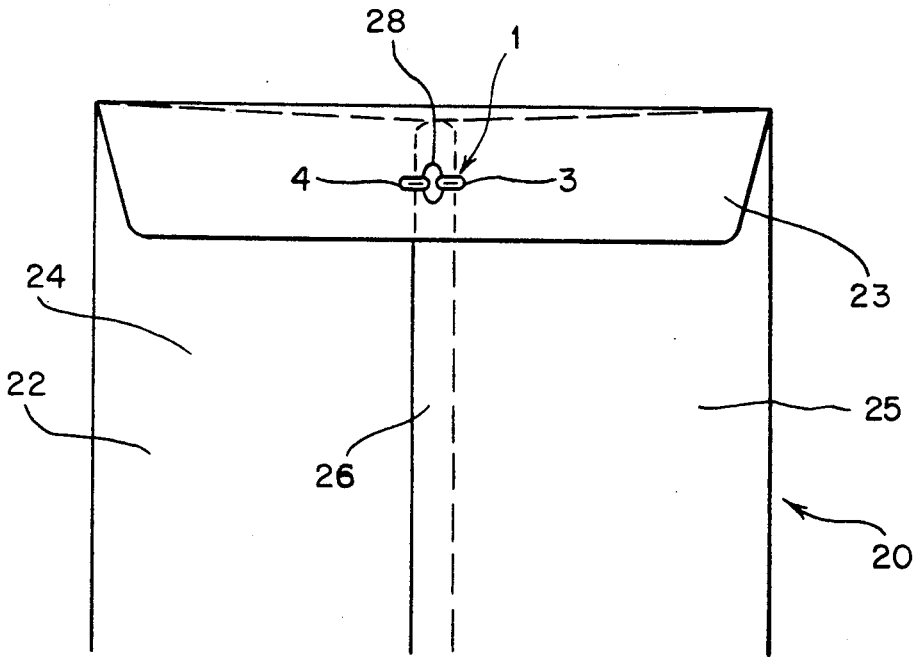
FIG. 11 is a plan view of a closed mailing envelope.
Figure 12:
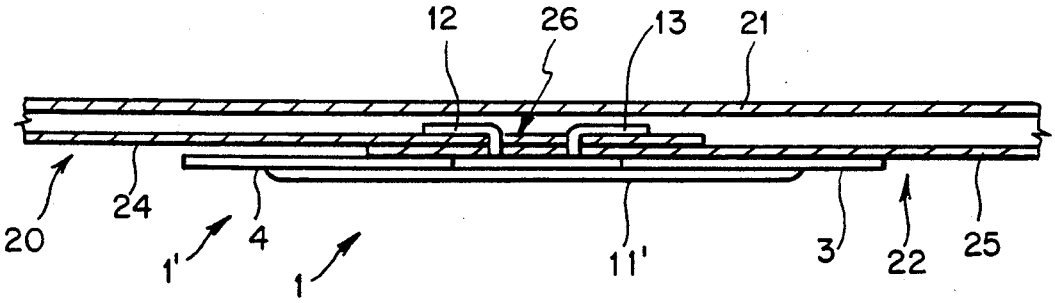
FIG. 12 is a cross-sectional taken along the line XII—XII of FIG. 10.

FIGS. 10 to 12 show a mailing envelope 20 having a glued center and a metal clip 1 according to the present invention. Mailing envelope 20 consists of a front wall 21 and a back wall 22, as well as a bottom flap (not shown) and a sealing or closing flap 23.

With mailing envelope 1 as shown, back wall 22 is formed by two lateral flaps 24 and 25, which are glued to each other within an overlapping zone 26, i.e., the glued center. In overlapped zone 26, metal clip 1 is anchored by means of its flanged-over prongs 12 and 13. The positioning of clip 1 has the same spacing "d" from closing flap folding line 27 as oval fastening aperture 28 arranged in sealing flap 23, which aperture is additionally reinforced, for example by eye 29 glued thereto. For sealing mailing envelope 20, lateral flaps 3 and 4 of metal clip 1 are first bent up, inserted through fastening aperture 28 of closing flap 23 as the latter is being folded over, and subsequently bent back onto the back side of closing flap 23, thus fixing the position thereof.

While only a single embodiment of the present invention has been shown and described, it will be obvious that many changes and modifications may be made thereunto without departing from the spirit and scope of the invention.

What is claimed is:

1. A metal clip for closing mailing envelopes and the like, comprising a central body having a longitudinal extension, lateral closing flaps transverse to the longitudinal extension of the central body;

two anchoring devices formed in the longitudinal extension of said central body, each said anchoring device having prongs formed by material segments bent out from an opening formed in a predetermined zone of the central body;

each said anchoring device including only two triangularly shaped prongs arranged parallel and opposite each other connected to the central body along parallel edges of the opening in the central body;

said parallel edges extending parallel with the longitudinal extension of the central body and forming bending edges of the prongs;

both prongs of one anchoring device are spaced apart and are parallel to the longitudinal extension of the central body;

both prongs of the other anchoring device are spaced apart and are parallel to the longitudinal extension of the central body; and each pair of opposite prongs is spaced the same distance from each other, whereby the prongs are aligned parallel.

2. The metal clip as defined in claim 1, wherein the opening and the zone serving with its material segments for forming the prongs has the shape of a quadrangle having two parallel edges forming the bending edges of the prongs.

3. The metal clip as defined in claim 1, wherein said prongs have the shape of a right-angled triangle wherein one leg forms the bending edge.

4. The metal clip as defined in claim 3, wherein said opening is square and the length of a prong is equal to the length of a side of the square opening.

5. A combination of the metal clip of claim 1 attached to a mailing envelope.

6. A metal clip for closing mailing envelopes and the like, comprising a central body having a longitudinal extension, lateral closing flaps transverse to the longitudinal extension of the central body, and two anchoring devices formed in the longitudinal extension of said central body, each said anchoring device having prongs formed by material segments bent out from an opening formed in a predetermined zone of the central body, each said anchoring device including only two triangularly shaped prongs arranged parallel and opposite each other connected to the central body along parallel edges of the square opening in the central body, said parallel edges extending parallel with the longitudinal extension of the central body and forming bending edges of the prongs;

wherein the opening and the zone serving with its material segments for forming the prongs has the shape of a square having two parallel edges forming the bending edges of the prongs;

wherein said prongs have the shape of a right-angled triangle wherein one leg forms the bending edge, wherein the length of the prong is equal to the length of a side of the square opening; and both prongs of one anchoring device are spaced apart and are parallel to the longitudinal extension of the central body;

both prongs of the other anchoring device are spaced apart and are parallel to the longitudinal extension of the central body; and each pair of opposite prongs is spaced the same distance from each other, whereby the prongs are aligned parallel.

7. A combination of the metal clip of claim 6 attached to a mailing envelope.

8. A metal clip for closing mailing envelopes and the like, comprising a central body having a longitudinal extension, lateral closing flaps transverse to the longitudinal extension of the central body, and two anchoring devices formed in the longitudinal extension of said central body, each said anchoring device having prongs formed by material segments bent out from a square opening formed in a predetermined zone of the central body, each said anchoring device including only two triangularly shaped prongs arranged parallel and opposite each other connected to the central body along parallel edges of the square opening in the central body, said parallel edges extending parallel with the longitudinal extension of the central body and forming bending edges of the prongs;

wherein the opening and the zone serving with its material segments for forming the prongs has the shape of a square having two parallel edges forming the bending edges of the prongs, with there being a first and a second square opening;

said first square having an upper right hand corner and a lower left hand corner with a diagonal extending from the upper right to the lower left corner;

said second square having an upper left hand corner and a lower right hand corner with a diagonal extending from the upper left to the lower right corner;

wherein said prongs have the shape of a right-angled triangle wherein one leg forms the bending edge, wherein the length of a prong is equal to the length of a side of each square opening; and each square opening being cut diagonally, with the diagonal of the first square being cut from the upper right hand corner to the lower left hand corner, and the diagonal of the second square being cut from the upper left hand corner to the lower right hand corner.

9. The combination of the metal clip of claim 8 attached to a mailing envelope.

* * * * *